US006894279B2

(12) United States Patent
Washebeck et al.

(10) Patent No.: US 6,894,279 B2
(45) Date of Patent: May 17, 2005

(54) NARROW WEB CORONA TREATER

(75) Inventors: Richard J. Washebeck, North Prairie, WI (US); Robert A. Kleinschmidt, Milwaukee, WI (US)

(73) Assignee: Illinois Tool Works Inc., Glenview, IL (US)

( * ) Notice: Subject to any disclaimer, the term of this patent is extended or adjusted under 35 U.S.C. 154(b) by 111 days.

(21) Appl. No.: 09/930,637

(22) Filed: Aug. 15, 2001

(65) Prior Publication Data

US 2002/0030161 A1 Mar. 14, 2002

Related U.S. Application Data

(60) Provisional application No. 60/232,169, filed on Sep. 11, 2000.

(51) Int. Cl.[7] ..... H01T 19/00
(52) U.S. Cl. ..... 250/324
(58) Field of Search ..... 250/324, 325, 250/326

(56) References Cited

U.S. PATENT DOCUMENTS

| | | | | |
|---|---|---|---|---|
| 3,405,052 A | | 10/1968 | Schirmer | |
| 4,260,240 A | * | 4/1981 | Pieper | 399/121 |
| 4,533,523 A | * | 8/1985 | Ahlbrandt | 422/186.05 |
| 4,556,544 A | * | 12/1985 | Ahlbrandt | 422/186.04 |
| 4,684,803 A | | 8/1987 | Collins | 250/324 |
| 5,278,409 A | | 1/1994 | Bonner | 250/525 |
| 5,281,174 A | | 1/1994 | Bonner | 439/825 |
| 5,293,043 A | | 3/1994 | Bonner | 250/324 |
| 5,332,897 A | | 7/1994 | Stobbe et al. | 250/305 |
| 5,437,844 A | | 8/1995 | Bonner | 422/186 |
| 6,106,659 A | * | 8/2000 | Spence et al. | 156/345.43 |

FOREIGN PATENT DOCUMENTS

| | | | |
|---|---|---|---|
| CH | 685043 A5 | | 3/1995 |
| DE | 27 53 711 A1 | | 6/1979 |
| DE | 2849233 A | * | 5/1980 |
| JP | 05273836 | | 10/1993 |

OTHER PUBLICATIONS

Vetaphone Internet Brochure.

* cited by examiner

*Primary Examiner*—Jack I. Berman
(74) *Attorney, Agent, or Firm*—Mark W. Croll; Paul F. Donovan

(57) ABSTRACT

A corona discharge device is adapted to be used in conjunction with a printing press. The device includes a cabinet housing an on-board power supply associated with a high voltage transformer. A rear end plate and a front end plate spaced apart in parallel relationship from the rear end plate both depend from the cabinet. An electrode support tube is fixedly mounted to the cabinet and has an electrode magazine slidably mounted on the support tube between an operative position and an inoperative position, the magazine including a series of parallel electrodes. A grounded treater roll is rotatably mounted on a first shaft between the rear end plate and the front end plate and below the support tube. A pair of spaced idler rolls is rotatably mounted on respective second and third shafts between the rear end plate and the front end plate below the treater roll such that a flexible web is guided upwardly by the idler rolls and wound about the treater roll beneath the electrodes.

20 Claims, 5 Drawing Sheets

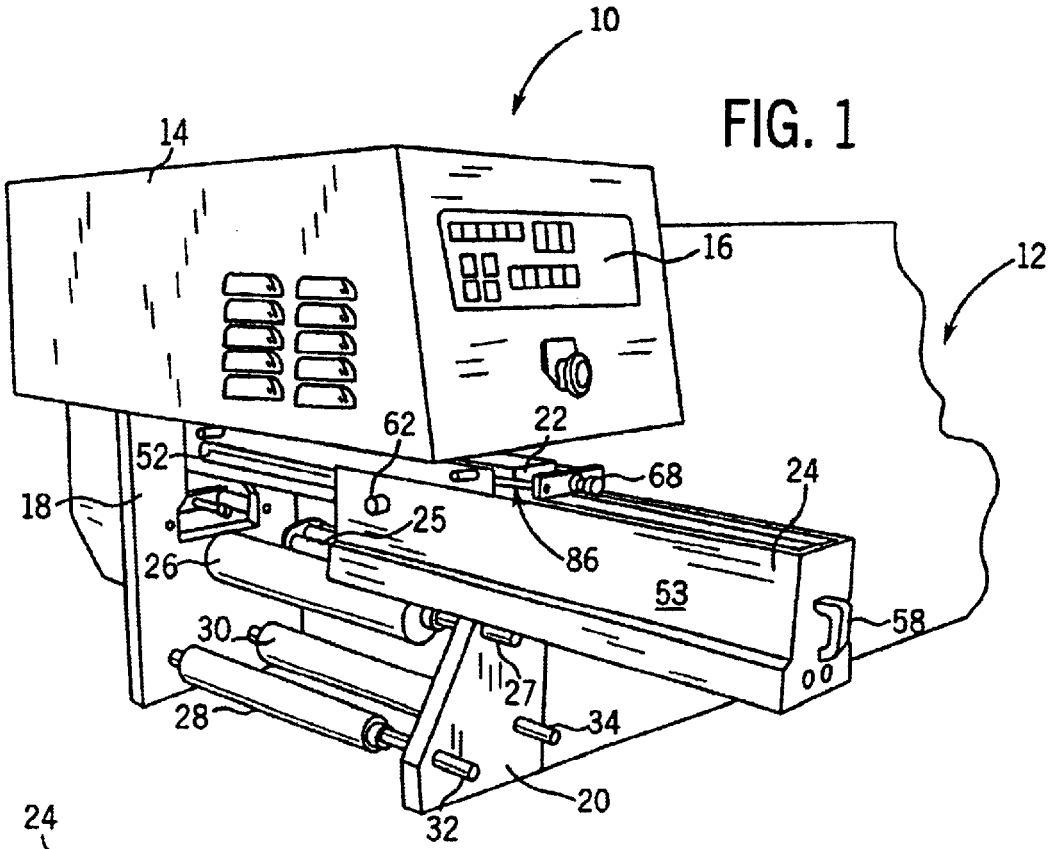
FIG. 1
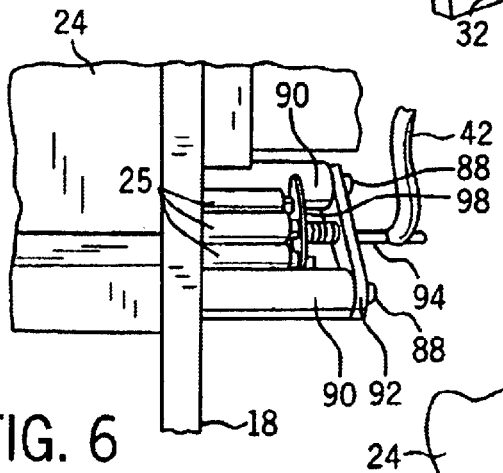
FIG. 6
FIG. 7
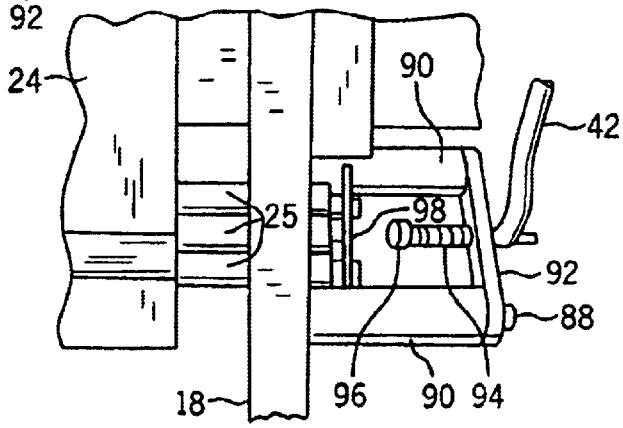

NARROW WEB CORONA TREATER

CROSS REFERENCE TO RELATED APPLICATIONS

This application is related to provisional U.S. Patent Application Ser. No. 60/232,169 filed Sep. 11, 2000.

FIELD OF THE INVENTION

This invention relates broadly to a corona discharge device and, more particularly, pertains to a unitized corona treater and power supply especially useful in narrow web applications.

BACKGROUND OF THE INVENTION

Corona discharge devices are used to treat the surface of various materials such as polyethylene web, by passing the web between a pair of electrodes. Generally, one of the electrodes comprises a grounded treater roll which is used to carry the web through a discharge zone, and a electrode assembly mounted for movement between an operative position spaced from the treater roll and an inoperative position for maintenance or repair. The electrode assembly includes a plurality of electrodes connected to a high voltage source and mounted on a common base with a hollow, ceramic or insulating member associated with each of the electrodes. The electrodes are offset from one another to provide a corona discharge across the entire surface of the web. The corona discharge treatment results in changing the molecular structure of the web so as to increase the wettability of the web which, in turn, makes the surface more amenable to receiving and retaining an applied coating such as, for example, printing ink for printing indicia on the web of a label press or the like.

The corona discharge device or treater has an electrode magazine that is normally removed for periodic cleaning and maintenance of the electrodes. In past designs, the connection between the high voltage source and the electrodes would normally be a high voltage wire joined permanently to the electrodes making it very difficult and extremely dangerous to remove the electrode magazine from the treater.

The corona treater also has mounting plate structure which connects the corona treating equipment to the frame of the label press. A front mounting plate normally supports the treater roll as well as a pair of web guide rolls and an electrode support tube, and provides the necessary alignment to reduce wrinkles and twisting of the web. In the past narrow web designs, the rolls were cantilevered from a single mounting plate or supported to permanently mounted plates at each end of the treater. The cantilevered design would not provide the mechanical strength for the longer treat width system and the two-plate design made installation difficult and more specifically designed for a particular press manufacturer.

The corona treating system further includes a mechanism to thread the web through the treater system and in addition, a method of cleaning the electrode assembly and performing maintenance. In the past, the electrode magazine would normally fasten to the electrode support tube and require the assembly to be rotated away from the treater roll before the magazine could be moved or cleaned. This method is very costly and takes up additional machine space for the pivoting of the electrode assembly.

The corona treater additionally has a mechanism which is used to adjust the gap between the high voltage electrodes and the treater roll. In past systems, this adjustment was normally accomplished with an adjustment device located on each end of the electrode assembly which raises and lowers the electrode depending on how far the adjustment device was turned. This type of adjustment did not provide consistent gap adjustment on both ends of the electrode assembly and requires a gapping gauge to set the proper distance between the electrode and the treater roll.

Accordingly, it is desirable to rectify the shortcomings of prior art constructions by providing a corona treater having a fast and simple, high voltage connection between the electrodes and high voltage source and which can be easily disconnected from the corona treater making removal of the electrode magazine safer and quicker. It is also desirable to provide a corona treater having a mounting plate design with the ability to adjust the frame to the type of press it was being mounted to allowing for a standard machine design for all presses. There is a need for a corona treater having a simple mechanism to support the electrode magazine which can easily slide out partially to allow webbing of the treater roll or can be completely removed for maintenance and cleaning. Likewise, there is a need for a corona treater having a single adjustment device at the front end of the treater system which is easily accessible to the operator. Such a single device when operated will adjust the electrode gap evenly across the treater roll surface and prevent uneven treatment levels due to improper adjustment.

SUMMARY OF THE INVENTION

It is a general object of the present invention to provide a corona treater which allows printers to produce high quality print on most any web or substrate.

It is one object of the present invention to provide a combined corona treater and power supply which will enable quick installation, easy operation, faster press speeds and increased productivity.

It is also an object of the present invention to provide a corona treater having an affordable, compact design with low maintenance.

In accordance with one aspect of the invention, a corona treater is provided with structure for permitting slidable mounting of the electrode magazine relative to the support tube.

In another aspect of the invention, a corona treater is provided with structure for enabling adjustment of the gap between the treater roll and the electrode magazine.

In yet another aspect of the invention, the corona treater provides for modular mounting to a variety of printing presses.

In still another aspect of the invention, the corona treater provides for a safe, spring-biased electrical connection between the electrodes and a high voltage source.

In one aspect of the invention, a corona discharge device is adapted to be used in conjunction with a printing press. The device includes a cabinet housing and on-board power supply associated with a high voltage transformer. A rear end plate depends from the cabinet, and a front end plate spaced apart in parallel relationship from the rear end plate also depends from the cabinet. An electrode support tube is fixedly mounted in the cabinet and has an electrode magazine slidably mounted on the support tube between an operative position and an inoperative position. The magazine includes a series of parallel electrodes. A grounded treater roll is rotatably mounted on a first shaft between the rear end plate and the front end plate and below the support tube. A pair of spaced idler rolls is rotatably mounted on respective second and third shafts between the rear end plate and the front end plate below the treater roll such that a flexible web is guided upwardly by the idler rolls and wound about the treater roll beneath the electrodes. The high voltage transformer includes a high voltage wire terminating in a high voltage connection for establishing a high voltage field between the electrodes and the treater roll. A high voltage connection includes a pair of non-conductive spacers projecting rearwardly from the rear end plate, a connector plate joining the spacers, a spring loaded screw connected to the high voltage wire and extending forwardly from the connector plate, and a conductive bus bar connected to the rear end of the electrodes and engagable with the screw when the magazine is in the operative position. A lower slide support is mounted between a bottom of the cabinet and a top of the support tube. The front end plate is slidably adjustable along the slide support and the first, second and third shafts to define a universal mounting device adapted to fit various frames of the printing press. A grooved slide track is secured for slidable movement to opposing sides of the support tube, and a pair of slide rails is mounted on the magazine such that the rails align with the grooved slide tracks to slidably support the magazine on the support tube. The front of the magazine includes a rotatable handle having a latch engagable with a suitable opening in the bottom of the support tube for holding the magazine in the operative position. The magazine includes detent structure engagable with the support tube for preventing and permitting slidable removal of the magazine from the support tube. The slide tracks include slot structure enabling the slide tracks when moved back and forth to simultaneously move up and down so that the magazine will be incrementally raised or lowered to enable an adjustment of a gap between the treater roll and the magazine. An adjustment device is mounted on a front of the support tube, the adjustment device including a rotatable knob having a rod tightly screw threaded into a cover plate on the support tube whereby unscrewing of the knob will permit the slide tracks to move back and forth as well as up and down.

In another aspect of the invention, a corona discharge device is provided for corona discharge treatment of continuous webs. The device has a front end plate and a rear end plate spaced from the front end plate in parallel relationship therewith. An electrode support tube is mounted on the front end plate for supporting an electrode magazine having a series of electrodes associated with a high voltage source. The magazine is movable between an operative, web treating position and an inoperative, maintenance position. A treater roll is rotatably mounted between the front end plate and the rear end plate below the support tube, and a pair of idler rolls is rotatably mounted between the front end plate and the rear end plate below the treater roll such that a web to be treated is guided upwardly by the idler rolls and wound about the treater roll beneath the electrodes. The invention is improved in one respect by a cabinet having an integral power supply joined in a high voltage connection to the electrodes for establishing a high voltage field between the treater roll and the electrodes. The high voltage connection enables hands-free connection of the electrodes with the power supply when the electrode magazine is in the operative position, and permits disconnection of the electrodes from the power supply when the electrode magazine is in the inoperative position. The invention is improved in another respect by slidable structure enabling the electrode magazine to be slidably mounted on the support tube between an operative or web treating position, and an inoperative or maintenance position. The invention is improved still further by an adjustable slide arrangement mounted on the support tube for enabling the front end plate to be slidably movable relative to the support tube so that the front end plate defines a universal mounting plate adapted to be connected to various frames of a printing press. The invention is still further improved by a slide and slot arrangement between the support tube and the electrode magazine providing sliding movement of the electrode magazine relative to the support tube, and simultaneously permitting incremental raising and lower of the electrode magazine relative to the support tube to enable adjustment of a gap between the treater roll and the magazine.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings:

FIG. 1 is a perspective view of the corona treater embodying the invention;

FIG. 6 is a perspective view of a high voltage electrode connection with the electrode magazine in an operative condition; and FIG. 7 is a perspective view of the high voltage electrode connection with the electrode magazine in an inoperative position.

DETAILED DESCRIPTION OF THE INVENTION

Figure 2:
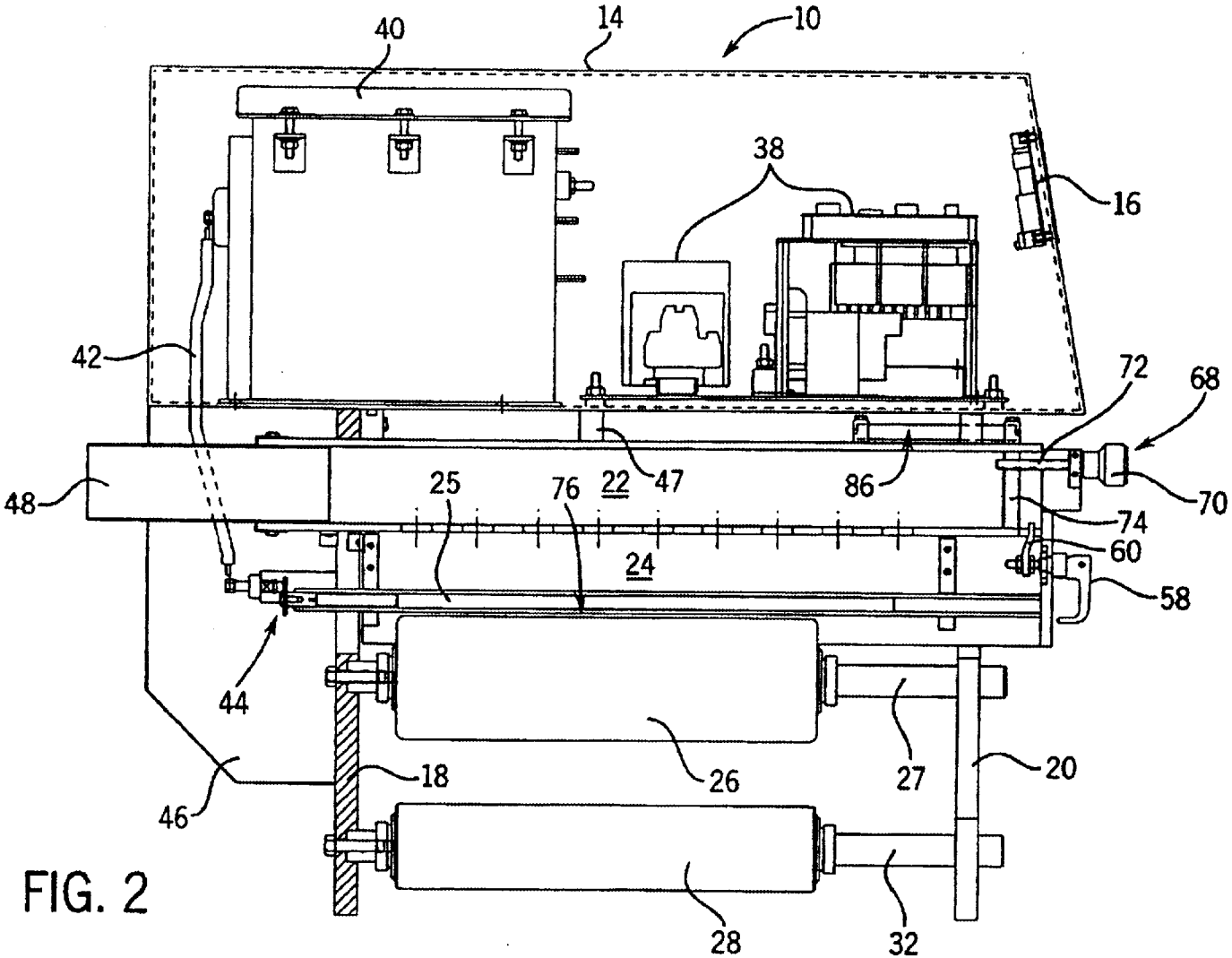
FIG. 2 is a longitudinal, cross sectional view taken through the corona treater of FIG. 1

Referring now to the drawings, FIG. 1 illustrates a corona discharge device or treater 10 embodying the invention and adapted to be used in conjunction with a printing press 12. In the preferred embodiment, the press 12 takes the form of a label or tag press, but it should be understood that the invention is equally adaptable to other systems involving flexo printing, coating or laminating of flexible webs or substrates.

Corona treater 10 is comprised of an integrated or on-board power supply cabinet 14 with a control panel 16 from which depends a rear end plate 18 and, in parallel relationship thereto, an adjustable front end plate 20 adapted to be connected to label press 12. As will be understood later, the adjustable front end plate 20 defines a salient feature of the invention which enables the universal mounting of the treater 10 to various press constructions. Supported below the cabinet 14 is a fixed electrode support tube 22 upon which a movable electrode magazine 24 having a series of parallel electrodes 25 is slidably disposed between an inoperative or maintenance position shown in FIG. 1, and an operative or web treating position shown in FIGS. 2 and 3. A grounded treater roll 26 is mounted for a rotation on a shaft 27 between the end plates 18 and 20 beneath the support tube 22. A pair of web guide or idler rollers 28, 30 is mounted for rotation on respective shafts 32, 34 between the end plates 18 and 20, and lie in space relationship below the treater roll 26. As seen in FIG. 4, a flexible web 36 is guided upwardly by the idler rolls 28, 30 and wound about the treater roll 26 in spaced relationship from the magazine 24 and electrodes 25.

Figure 3:
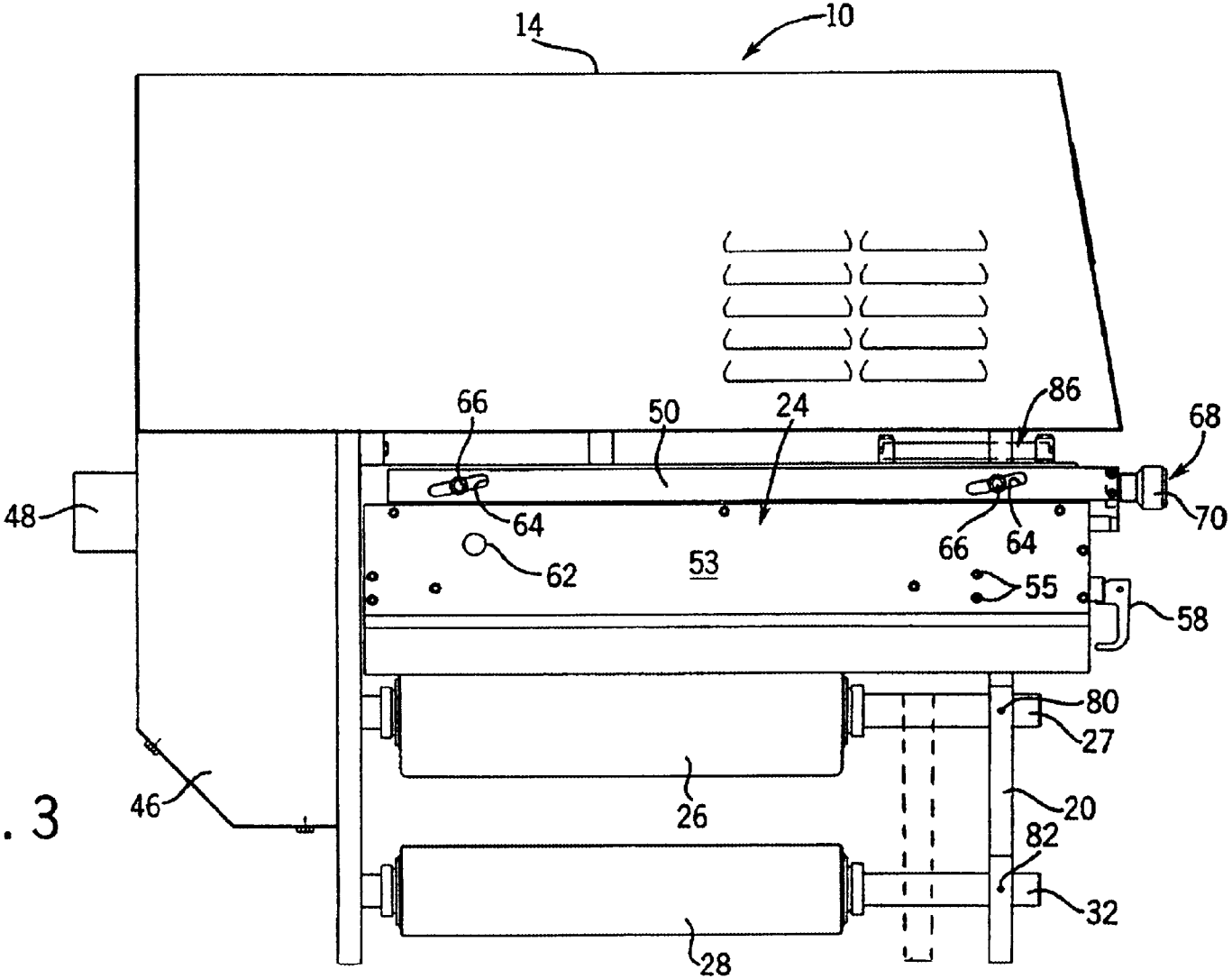
FIG. 3 is a side elevational view of the corona treater in FIG. 1.
Figure 4:
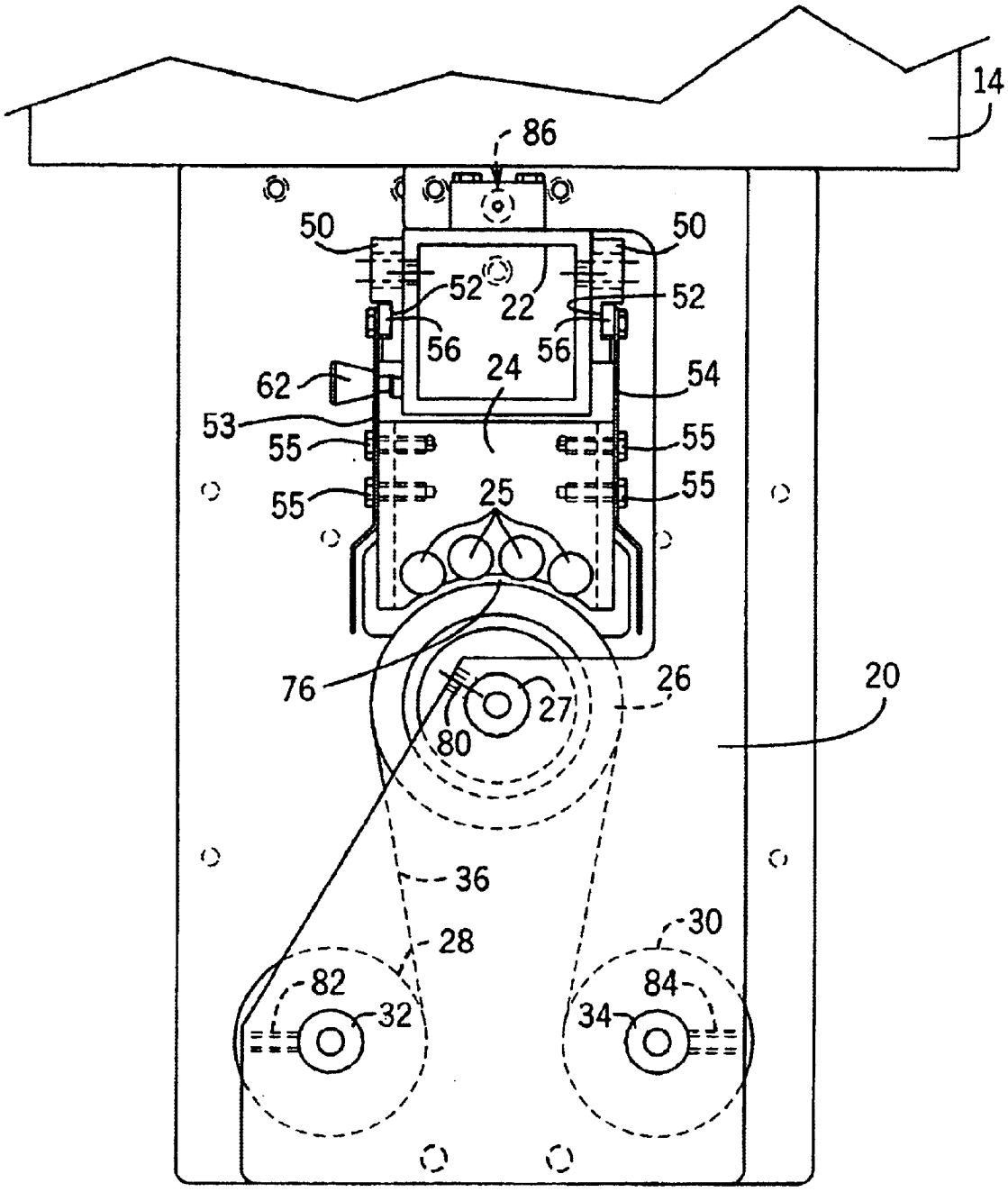
FIG. 4 is a fragmentary, cross sectional view of the front end of the corona treater shown in FIG. 2.

Referring now to FIGS. 2 and 3, the power supply cabinet 14 includes a power supply 38 and a high voltage transformer 40 provided with a high voltage wire 42. The wire 42 terminates in a high voltage connection 44 normally enclosed by a high voltage cover plate 46 located behind rear end plate 18. A high voltage connection 44 forms another distinctive feature of the invention which will be more fully described hereafter. At this point, it should be appreciated that the high voltage connection 44 establishes a high voltage field between treater roll 26 and one or more electrodes 25 with the substrate or web 36 to be treated interposed between electrodes 25 and roll 26. As is well known, the high voltage field establishes a corona discharge that causes the chemical composition of the material to be modified which, in turn, improves selected characteristics of the material such as wettability so that printed matter or coating may be more advantageously adhered thereto.

Support tube 22 passes through appropriate aligned cutouts in the respective end plates 18 and 20, and is supported by a bracket 47 attached to the cabinet 14. In the preferred embodiment, support tube 22 has a generally square cross section except for a rearward exhaust tube portion 48 which is generally circular in cross section. The exhaust tube 48 facilitates the venting of ozone generated during the corona treatment and cooling for the electrodes thereof.

Figure 5:
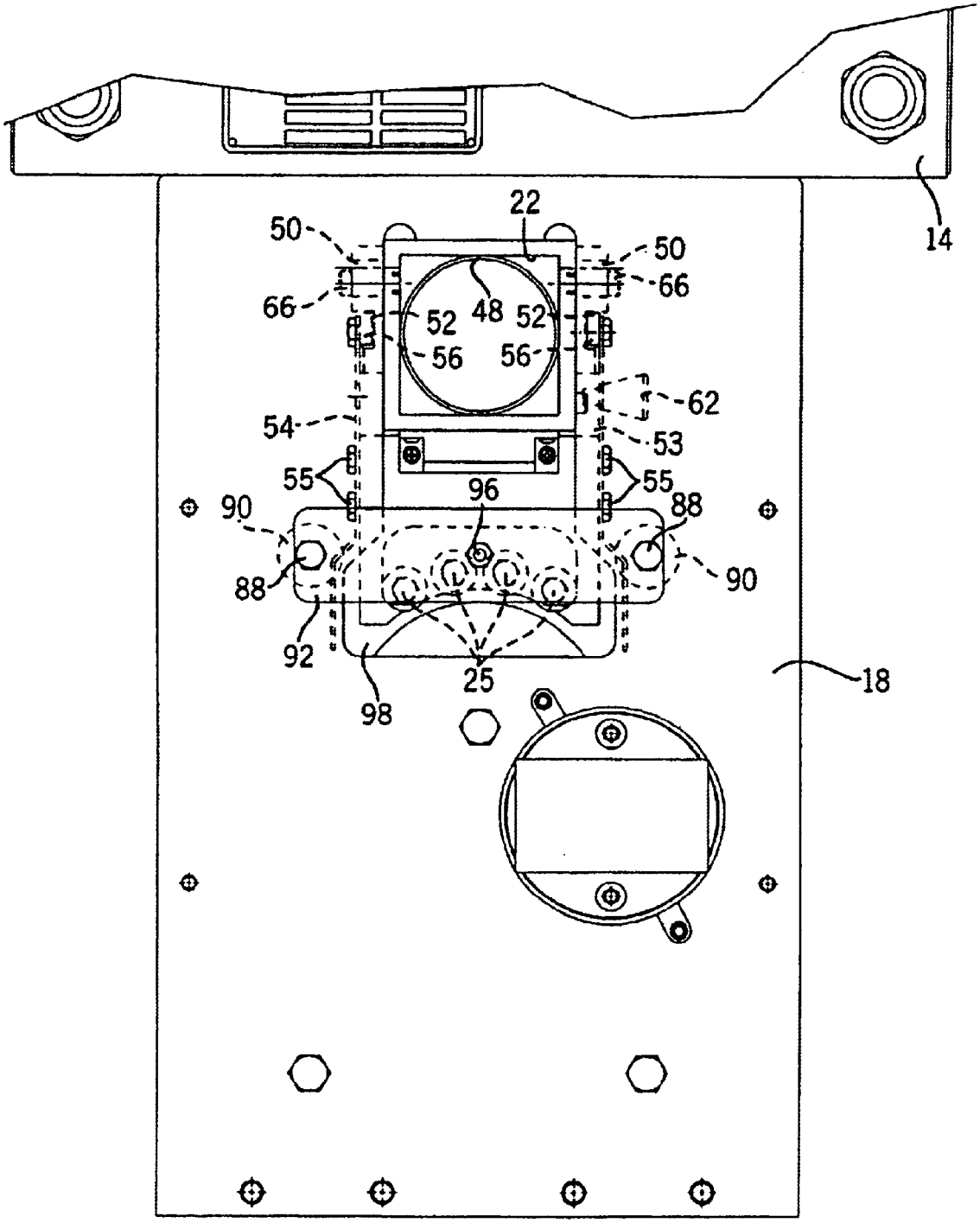
FIG. 5 is a fragmentary, cross sectional view of the rear end of the corona treater shown in FIG. 2.

As best seen in FIGS. 1, 4 and 5, a slide track 50 having a groove 52 formed along its length is secured to each side of the support tube 22. Electrode magazine 24 has a pair of shields 53, 54 which are connected by fasteners 55 to the sides thereof. The magazine 24 also has a pair of slide rails 56 mounted to the inside, top portion of the shields 53, 54. The rails 56 align with the grooves 52 provided in the slide tracks 50 on support tube 22 and slidably support the electrode magazine 24 on the support tube 22 above the treater roll 26. A lever locking, rotatable handle 58 located on the front of the magazine 24 has a latch 60 engagable with a suitable opening in the bottom of the support tube 22 for holding the magazine 24 in the treating position shown in FIGS. 2 and 3. When the need to attend to the web 36 arises, the handle 58 is opened and rotated allowing the magazine 24 to be slid forwardly (as shown in FIG. 1) opening up an area between the treater roll 26 and the support tube 22 for webbing the treater 10. A spring-set, detent pin 62 located on shield 53 of the magazine 24 engages with the support tube 22 and prevents magazine 24 from being completely removed. To remove the entire magazine 24 from the treater 10, the knob of the detent pen 62 must be pulled out allowing the magazine 24 to slide entirely away from the support tube 22. The slide track and slide rail structure provide a useful feature in slidably supporting the magazine 24 relative to the support tube 22 to allow webbing of the treater 10 or complete removal of the magazine 24 for maintenance or cleaning of the electrodes 25.

Each slide track 50 is also provided at its forward and rearward ends with a diagonally extending slot 64 (FIG. 3) through which a shoulder screw 66 is passed for insertion in support tube 22. Mounted on the front of the support tube 22 is an adjustment device 68 consisting of a rotatable knob 70 having a rod 72 tightly screw threaded into a cover plate 74 on the support tube 22. Slide tracks 50 are moved slightly back and forth and simultaneously up and down via the shoulder screw 66 riding in the slot 64 when the knob 70 is rotated. As a result, magazine 24 which is attached to support tube 22 via the slide tracks 50 will be incrementally raised or lowered to enable fast, accurate adjustment of the gap 76 between the magazine 24 and the treater roll 26. This unique feature thus enables a convenient single point gap adjustment which provides the ability to locate a gap adjustment gauge (not shown) to set the desired gap adjustment.

Referring further to FIGS. 3 and 4, the adjustable front end plate 20 is secured to the shafts 27, 32, and 34 by respective set screws 80, 82 and 84. Between the bottom of cabinet 14 and the top of support tube 22 is a rod and slide assembly or linear slide support 86 along which the top of the end plate 20 slides. Loosening of the screws 80, 82, 84 enables the end plate 20 to be slidably adjusted longitudinally along the shafts 27, 32 and 34 and slide support 86 such as to a position shown in phantom lines in FIG. 3, at which the screws 80, 82, 84 are again tightened. The treater roll 26 and the idler rolls 28, 30 may also be shifted into appropriate alignment along their respective shafts 27, 32, 34 once the end plate 20 has been set. The adjustable end plate 20 provides a universal mounting device which enables the treater 10 to be easily adapted to various press machine frame variations.

FIGS. 6 and 7 show the details of the high voltage connection 44 between the electrodes 25 and the high voltage source 38, 40. Projecting rearwardly from the fixed rear end plate 18 is a pair of bolts 88 surrounded by non-conductive spacers 90 and joined at their ends by a connector plate 92. The plate 92 has a center opening for receiving a spring loaded screw 94 having a rearward end connected to high voltage wire 42 and a forward end with an acorn nut 96. The acorn nut 96 is in electrical contact with a conductive bus bar 98 attached at the end of the electrodes 25 when the magazine 24 is in the operative or web treating position as shown in FIG. 6. The acorn nut 96 is disengaged from the conductive bar 98 when the magazine 24 is in the slide out position shown in FIG. 7. The high voltage connection 44 permits a fast, simple electrical connection between the electrodes 25 and the high voltage source 38, 40 which can be easily disconnected from the treater 10 making removal of the electrode magazine 24 safer and quicker.

It should be appreciated that the present invention provides a corona treater 10 which incorporates an on-board power supply saving the expense of installing a separate corona treating station and a separate power supply. The universal end plate 20 also enables a quick mounting arrangement to a wide variety of presses with a minimum of set up time. The slidable mounting of the electrode magazine 24 permits efficient webbing and maintenance. The front access, single point gap adjustment allows users to quickly and conveniently set the gap between the electrodes 25 and the treater roll 26. The high voltage connection 44 creates a hands-free, safer means by which the electrode magazine 24 may be removed without disabling a permanent connection of the high voltage wire 42.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention.

We claim:

1. A corona discharge device adapted to be used in conjunction with a printing press, the device comprising:

a cabinet housing an on-board power supply associated with a high voltage transformer;

a rear end plate depending from the cabinet;

a front end plate spaced apart in parallel relationship from the rear end plate and depending from the cabinet;

an electrode support tube fixedly mounted to the cabinet and having a corona electrode magazine slidably mounted on the support tube in parallel relationship thereto so as to be movable parallel therewith between an operative position and an inoperative position while remaining mounted on said electrode support tube, the magazine including a series of parallel corona electrodes;

a grounded treater roll rotatably mounted on a first shaft between the rear end plate and the front end plate and below the support tube; and a pair of spaced idler rolls rotatably mounted on respective second and third shafts between the rear end plate and the front end plate below the treater roll such that a flexible web is guided upwardly by the idler rolls and wound about the treater roll beneath the electrodes.

2. Thee corona discharge device of claim 1, wherein the high voltage transformer includes a high voltage wire terminating in a high voltage connection for establishing a high voltage field between the electrodes and the treater roll.

3. The corona discharge device of claim 2, wherein the high voltage connection includes a pair of non-conductive spacers projecting rearwardly from the rear end plate, a connector plate joining the spacers, a spring loaded screw connected to the high voltage wire and extending forwardly from the connector plate, and a conductive bus bar connected to the rear end of the electrodes and engagable with the screw when the magazine is in the operative position.

4. The corona discharge device of claim 1, wherein a linear slide support is mounted between a bottom of the cabinet and a top of the support tube, the front end plate being slidably adjustable along the slide support and the first, second and third shafts to define a universal mounting device adapted to fit various frames of the printing press.

5. The corona discharge device of claim 1, wherein a grooved slide track is secured for slidable movement to opposing sides of the support tube, and a pair of slide rails is mounted on the magazine such that the rails align with the grooved slide tracks to slidably support the magazine on the support tube.

6. The corona discharge device of claim 1, wherein the front of the magazine includes a rotatable handle having a latch engagable with a suitable opening in the bottom of the support tube for holding the magazine in the operative position.

7. The corona discharge device of claim 1, wherein the magazine includes detent structure engagable with the support tube for preventing and permitting slidable removal of the magazine from the support tube.

8. The corona discharge device of claim 5, wherein the slide tracks include slot structure enabling the slide tracks when moved back and forth to simultaneously move up and down so that the magazine will be incrementally raised or lowered to enable adjustment of a gap between the treater roll and the magazine.

9. The corona discharge device of claim 8, wherein an adjustment device is mounted on a front of the support tube, the adjustable device including a rotatable knob having a rod tightly screw threaded into a cover plate on the support tube, whereby unscrewing of the knob will permit the slide tracks to move back and forth as well as up and down.

10. A corona discharge device for corona discharge treatment of continuous webs, the device having a front end plate and a rear end plate spaced from the front end plate in parallel relationship therewith, an electrode support tube mounted on the front end plate for supporting a corona electrode magazine having a series of corona electrodes associated with a high voltage source, the magazine being movable between an operative, web treating position and an inoperative, maintenance position while remaining mounted on said electrode support tube, a treater roll rotatably mounted between the front end plate and the rear end plate below the support tube and a pair of idler rolls rotatably mounted between the front end plate and the rear end plate below the treater roll such that a web to be treated is guided upwardly by the idler rolls and wound about the treater roll beneath the electrodes, a cabinet integrally associated with at least one of the front end plate and the rear end plate, the cabinet housing a power supply and an integral high voltage transformer provided with a high voltage wire joined in a high voltage connection to the electrodes for establishing a high voltage field between the treater roll and the electrodes.

11. A corona discharge device for corona discharge treatment of continuous webs, the device having a front end plate and a rear end plate spaced from the front end plate in parallel relationship therewith, an electrode support tube mounted on the front end plate for supporting a corona electrode magazine having a series of corona electrodes associated with a high voltage source, the magazine being movable between an operative, web treating position and an inoperative, maintenance position while remaining mounted on said electrode support tube, a treater roll rotatably mounted between the front end plate and the rear end plate below the support tube and a pair of idler rolls rotatably mounted between the front end plate and the rear end plate below the treater roll such that a web to be treated is guided upwardly by the idler rolls and wound about the treater roll beneath the electrodes, and a cabinet housing a power supply and an integral high voltage transformer provided with a high voltage wire joined in a high voltage connection to the electrodes for establishing a high voltage field between the treater roll and the electrodes, wherein the high voltage connection between the electrodes and the power supply enables the electrodes to be connected with the power supply when the electrode magazine is in the operative position in such a manner that the electrodes themselves are not handled or contacted, and permits disconnection of the electrodes from the power supply when the electrode magazine is in the inoperative position also in such a manner that the electrodes themselves are not handled or contacted.

12. The corona discharge device of claim 11, wherein the high voltage connection includes a pair of non-conductive spacers projecting rearwardly from the rear end plate, a connector plate joining the spacers, a spring loaded screw connected to the high voltage wire and extending forwardly from the connector plate, and a conductive bus bar connected to the rear end of the electrodes and engagable with the screw when the magazine is in the operative position.

13. In a corona discharge device for corona discharge treatment of continuous webs, the device having a front end plate and a rear end plate spaced from the front end plate in parallel relationship therewith, an electrode support tube mounted on the front end plate for supporting a corona electrode magazine having a series of corona electrodes associated with a high voltage source, the magazine movable between an operative, web treating position and an inoperative, maintenance position, a treater roll rotatably mounted between the front end plate and the rear end plate below the support tube and a pair of idler rolls rotatably mounted between the front end plate and the rear end plate below the treater roll such that a web to be treated is guided upwardly by the idler rolls and wound about the treater roll beneath the electrodes, the improvement comprising:

slidable structure enabling the electrode magazine to be slidably mounted on the support tube between an operative or web treating position and an inoperative or maintenance position, the slidable structure being adapted and configured in such a manner that the electrode magazine can remain mounted to the support tube when in both the operative or web treating position and the inoperative or maintenance position.

14. The corona discharge device of claim 13, wherein a grooved slide track is secured for slidable movement to opposing sides of the support tube, and a pair of slide rails is mounted on the magazine such that the rails align with the grooved slide tracks to slidably support the magazine on the support tube.

15. The corona discharge device of claim 13, wherein the magazine includes detent structure engagable with the support tube for preventing and permitting slidable removal of the magazine from the support tube.

16. A corona discharge device for corona discharge treatment of continuous webs, the device having a front end plate and a rear end plate spaced from the front end plate in parallel relationship therewith, an electrode support tube mounted on the front end plate for supporting a corona electrode magazine having a series of corona electrodes associated with a high voltage source, the magazine being movable between an operative, web treating position and an inoperative, maintenance position while remaining mounted on said electrode support tube, a treater roll rotatably mounted between the front end plate and the rear end plate below the support tube and a pair of idler rolls rotatably mounted between the front end plate and the rear end plate below the treater roll such that a web to be treated is guided upwardly by the idler rolls and wound about the treater roll beneath the electrodes, an adjustable slide arrangement mounted on the support tube for enabling the front end plate to be slidably movable relative to support tube so that the front end plate defines a universal mounting plate adapted to be connected to various frames of a printing press.

17. The corona discharge device of claim 16, wherein a linear slide support is mounted between a bottom of the cabinet and a top of the support tube, the front end plate being slidably adjustable along the slide support to define a universal mounting device adapted to fit various frames of a printing press.

18. A corona discharge device for corona discharge treatment of continuous webs, the device having a front end plate and a rear end plate spaced from the front end plate in parallel relationship therewith, an electrode support tube mounted on the front end plate for supporting a corona electrode magazine having a series of corona electrodes associated with a high voltage source, the magazine being movable between an operative, web treating position and an inoperative, maintenance position while remaining mounted on said electrode support tube, treater roll rotatably mounted between the front end plate and the rear end plate below the support tube and a pair of idler rolls rotatably mounted between the front end plate and the rear end plate below the treater roll, such that a web to be treated is guided upwardly by the idler rolls and wound about the treater roll beneath the electrodes, and a slide and slot arrangement between the support tube and the electrode magazine providing sliding movement of the electrode magazine relative to the support tube, and simultaneously permitting incremental raising and lowering of the electrode magazine relative to the support tube between two end positions to enable incremental adjustment of a gap between the treater roll and the magazine between the two end positions during at least the operative, web treating position.

19. The corona discharge device of claim 18 wherein a grooved slide track is secured for slidable movement to opposing sides of the support tube, and a pair of slide rails is mounted on the magazine such that the rails align with the grooved slide tracks to slidably support the magazine on the support tube, and wherein the slide tracks include slot structure enabling the slide tracks when moved back and forth to simultaneously move up and down so that the magazine will be incrementally raised or lowered to enable adjustment of the gap between the treater roll and the magazine.

20. The corona discharge device of claim 19, wherein an adjustment device is mounted on a front of the support tube, the adjustable device including a rotatable knob having a rod tightly screw threaded into a cover plate on the support tube, whereby unscrewing of the knob will permit the slide tracks to move back and forth as well as up and down.

* * * * *